US009812765B2

(12) United States Patent
Hong et al.

(10) Patent No.: US 9,812,765 B2
(45) Date of Patent: Nov. 7, 2017

(54) ANTENNA ASSEMBLY AND MOBILE TERMINAL USING SAME

(71) Applicants: Ng Guan Hong, Shenzhen (CN); Tay Yew Siow, Shenzhen (CN)

(72) Inventors: Ng Guan Hong, Shenzhen (CN); Tay Yew Siow, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 52 days.

(21) Appl. No.: 14/217,634

(22) Filed: Mar. 18, 2014

(65) Prior Publication Data

US 2014/0285384 A1 Sep. 25, 2014

(30) Foreign Application Priority Data

Mar. 22, 2013 (CN) ..... 2013 1 0096530

(51) Int. Cl.
*H01Q 1/24* (2006.01)
*H01Q 5/371* (2015.01)

(52) U.S. Cl.
CPC ..... *H01Q 1/243* (2013.01); *H01Q 5/371* (2015.01)

(58) Field of Classification Search
CPC ..... H01Q 5/371; H01Q 1/243
USPC ..... 343/702, 726, 728, 741, 742, 748, 789, 343/842, 855, 872
See application file for complete search history.

(56) References Cited

U.S. PATENT DOCUMENTS 2,615,134 A * 10/1952 Carter ..... H01Q 9/16 333/26
4,632,128 A * 12/1986 Paglione ..... A61N 5/04 219/746
2004/0267419 A1* 12/2004 Jeng ..... B60R 1/12 701/36
2011/0317070 A1* 12/2011 Kimura ..... G06F 3/1423 348/552

* cited by examiner

*Primary Examiner* — Hoang Nguyen
*Assistant Examiner* — Jae Kim
(74) *Attorney, Agent, or Firm* — Na Xu; IPro, PLLC

(57) ABSTRACT

An embodiment of the present invention provides an antenna assembly and a mobile terminal. The antenna assembly includes an antenna body provided with a grounding plate and a feeding portion. The antenna body includes a radiating portion provided with an unclosed loop structure. The antenna assembly further has a metal frame. The metal frame is provided with a closed first loop portion surrounding an outer periphery of the radiating portion. An annular gap is formed between the first loop portion and the radiating portion. The antenna assembly of the present disclosure improves the product performance and makes the product appearance more aesthetic.

4 Claims, 5 Drawing Sheets

ANTENNA ASSEMBLY AND MOBILE TERMINAL USING SAME

FIELD OF THE INVENTION

The present disclosure relates to an antenna assembly, and more particularly, to a mobile terminal using the antenna assembly.

DESCRIPTION OF RELATED ART

With development of the communication technologies, use of wireless mobile devices and, especially, mobile phones, becomes increasingly wider. Nowadays, the mobile communication devices such as mobile phones are required to not only have the simple calling function, but also have a miniaturized size and a good voice quality. Correspondingly, as an important component in the communication devices, the antenna assembly has received more and more attention.

Taking a mobile phone as an example, conventionally the antenna assembly is embedded in the mobile phone, and typically comprises an antenna body and a metal frame. The metal frame comprises a first portion, a second portion and a gap. The first portion cooperates with the second portion to form a loop structure around the mobile phone, and the first portion and the second portion are disposed opposite to each other across the gap. In this way, the first portion is used as a radiating body of the antenna. However, the gap in the metal frame of this structure not only becomes a sensitive portion of the antenna assembly, but also adversely affects the aesthetic appearance of the product.

Accordingly, there is a need to provide a new kind of antenna assembly to solve the aforesaid problem.

SUMMARY OF THE INVENTION

A primary objective of the present disclosure is to provide an antenna assembly capable of improving antenna performance and a mobile terminal using the antenna assembly.

To achieve the aforesaid object, an embodiment of the present disclosure provides an antenna assembly, which comprises an antenna body provided with a grounding plate and a feeding portion. The antenna body comprises a radiating portion provided with an unclosed loop structure. The antenna assembly further comprises a metal frame. The metal frame is provided with a closed first loop portion surrounding an outer periphery of the radiating portion. An annular gap is formed between the first loop portion and the radiating portion.

The present disclosure further provides an embodiment of a mobile terminal, which comprises an antenna assembly, a USB module, a speaker module and a supporting plate for supporting the USB module and the speaker module. The antenna assembly comprises an antenna body provided with a grounding plate and a feeding portion. The antenna body comprises a body portion provided with an unclosed loop structure. The antenna assembly further comprises a metal frame. The metal frame is provided with a closed first loop portion surrounding an outer periphery of the body portion. An annular gap is formed between the first loop portion and the body portion.

The benefits of the present disclosure are that: since the first loop portion of the metal frame has a closed loop structure, the first loop portion is coupled to the radiating portion as a parasitic unit, so that the radiating area is increased, the product performance is improved, and the product appearance becomes more aesthetic.

DETAILED DESCRIPTION OF EXEMPLARY EMBODIMENT OF THE INVENTION

The present disclosure will be further described below with reference to the attached drawings and embodiments thereof.

Figure 1:
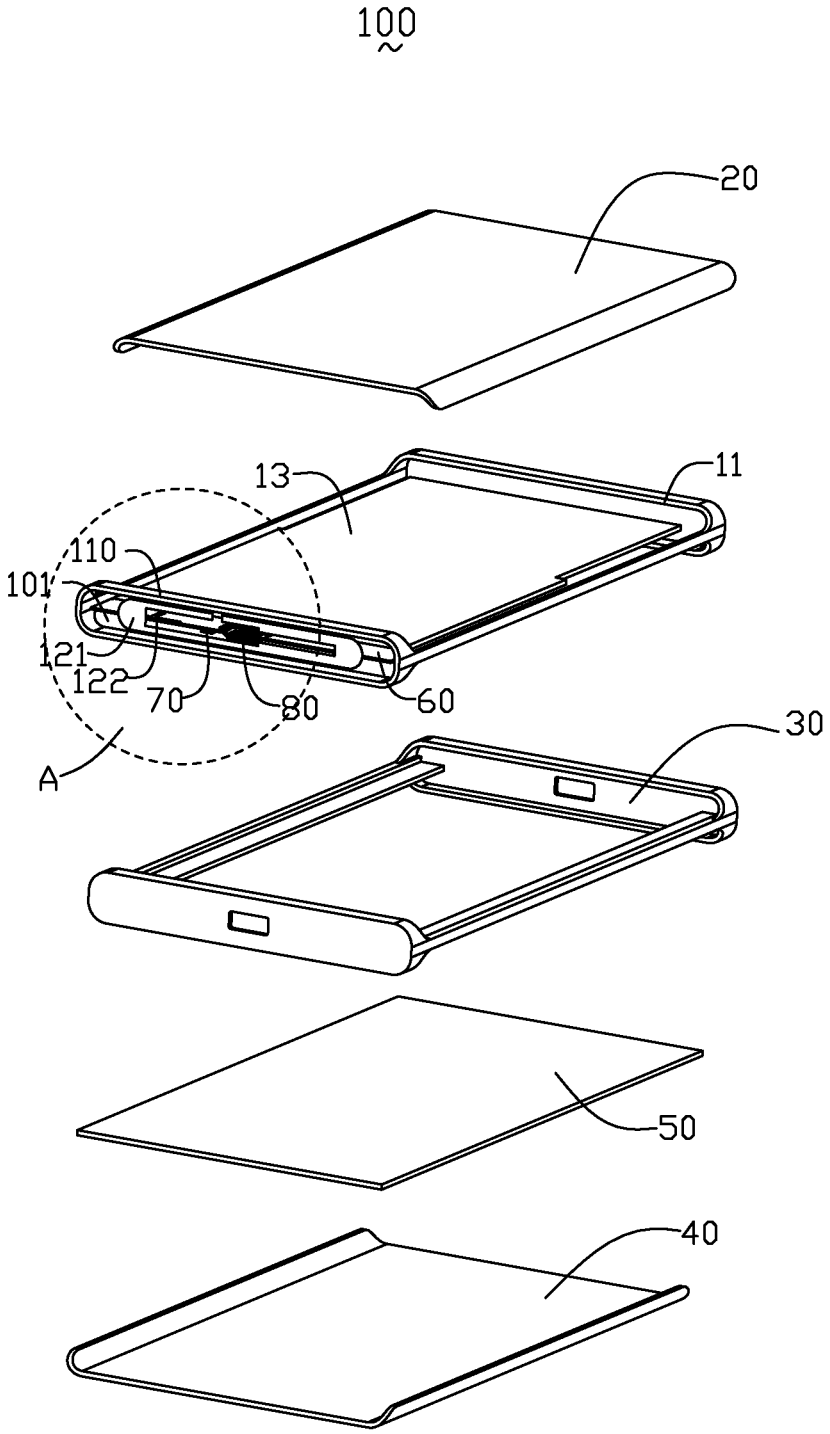
FIG. 1 is an isometric exploded view of a mobile terminal according to an embodiment of the present disclosure from an aspect.
Figure 2:
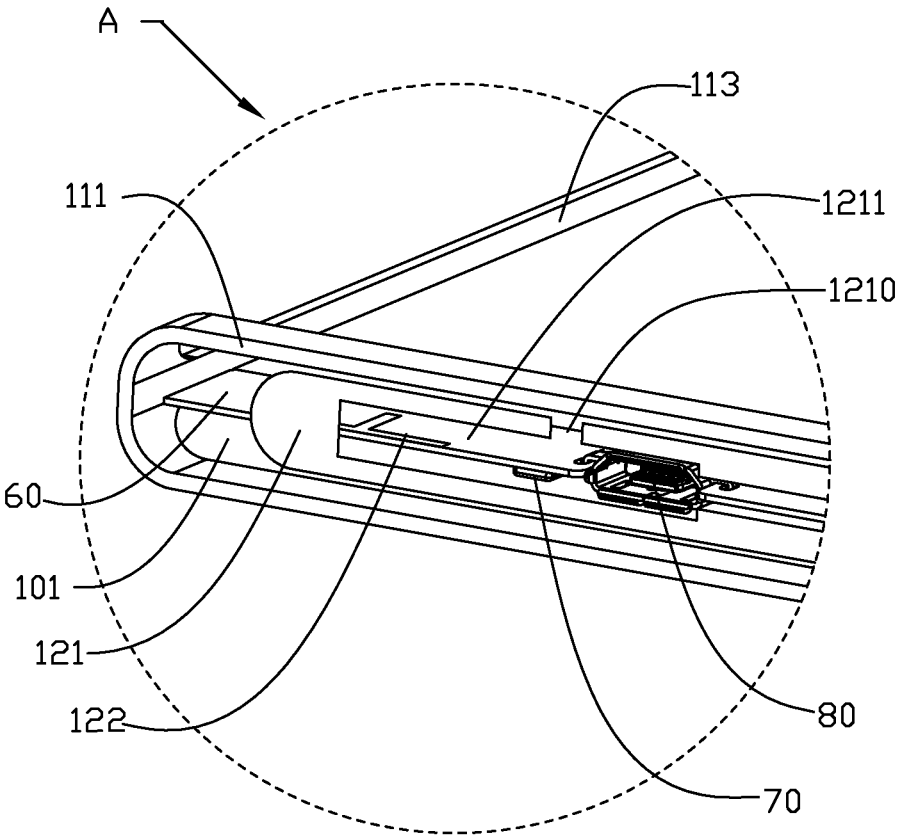
FIG. 2 is a partially enlarged schematic view of a region A in FIG. 1.
Figure 3:
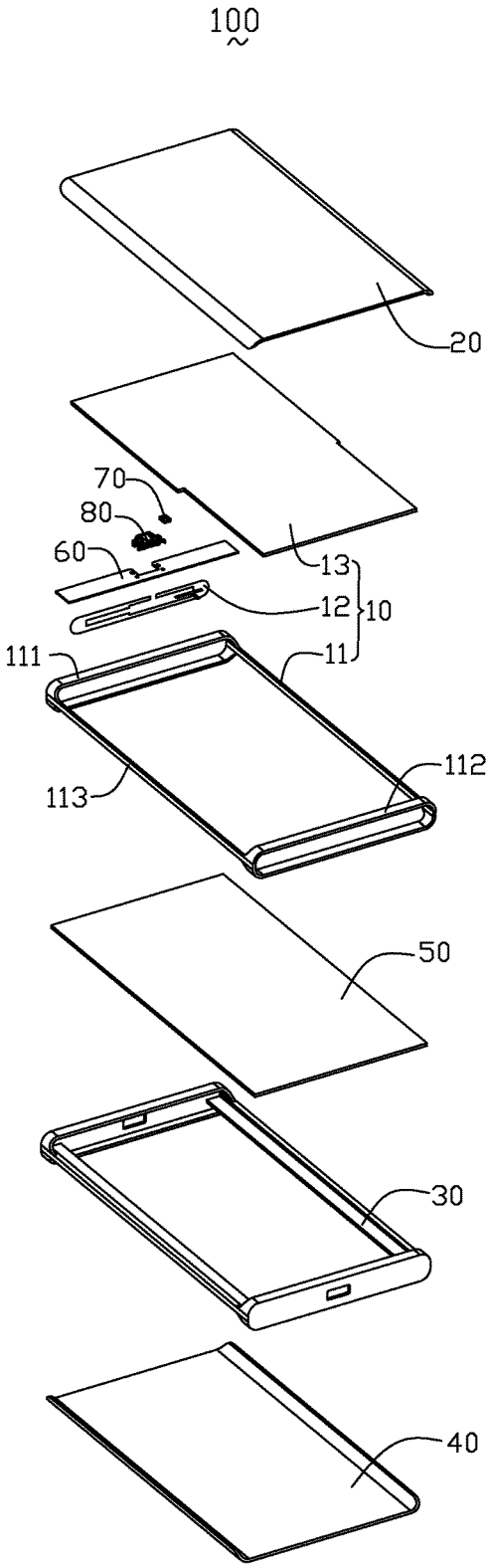
FIG. 3 is an isometric exploded view of the mobile terminal according to the embodiment of the present disclosure from another aspect.

Refer to FIG. 1, FIG. 2 and FIG. 3 together. FIG. 1 is an isometric exploded view of an embodiment of a mobile terminal according the present disclosure. FIG. 2 is a partially enlarged schematic view of a region A in FIG. 1. FIG. 3 is an isometric exploded view of the mobile terminal of FIG. 1 from an aspect. The mobile terminal 100 may be a mobile phone, a tablet computer, a multimedia player or the like. For ease of understanding, the following embodiment will be described by taking a smart phone as an example.

The mobile terminal 100 comprises an antenna assembly 10, a display module 20, an enclosure 30, a lower cap 40, a ferrite plate 50, a speaker module 70 and a USB module 80. The display module 20 is stacked on the antenna assembly 10. The lower cap 40 cooperates with the enclosure 30 to form a receiving space for receiving the display module 20, the antenna assembly 10 and the ferrite plate 50. The speaker module 70 and the USB module 80 are disposed on a side surface of the antenna assembly 10.

Figure 4:
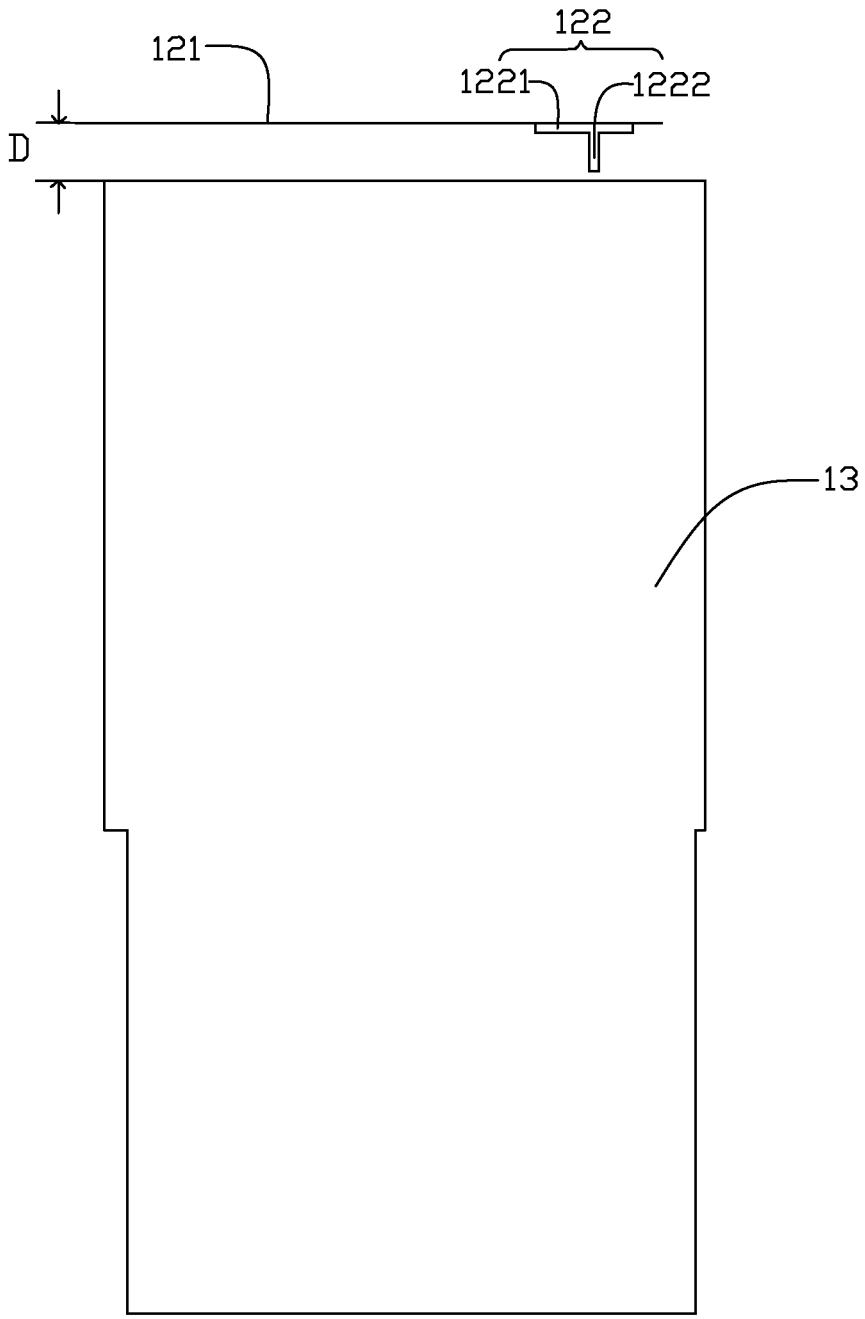
FIG. 4 is a plan view illustrating an antenna body combined with a grounding plate of FIG. 3.
Figure 5:
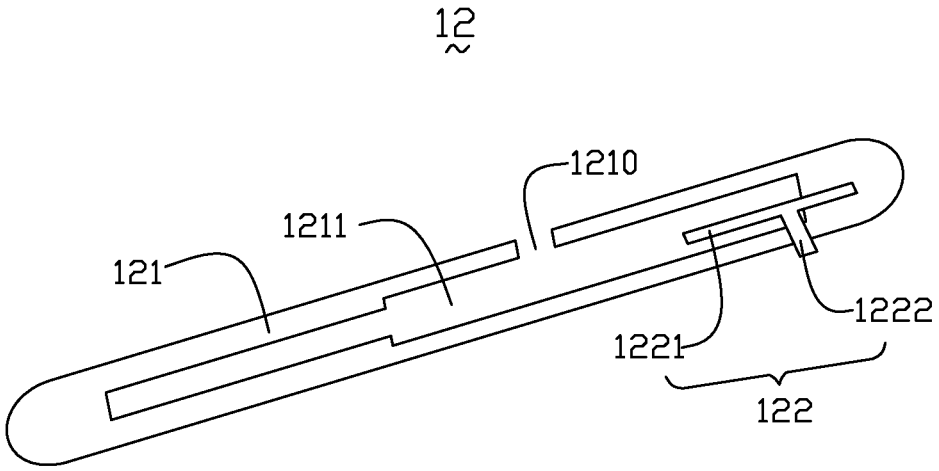
FIG. 5 is a perspective view of the antenna body of the mobile terminal.

Referring to the FIG. 4 and FIG. 5 together, the antenna assembly 10 comprises a metal frame 11, an antenna body 12 and a grounding plate 13. The antenna body 12 comprises a radiating portion 121 and a T-shaped branch portion 122 that extends vertically from an end of the radiating portion in a direction away from the radiating portion. The ferrite plate 50 is attached to a surface of the grounding plate 13.

Referring to FIG. 5, the radiating portion 121 has an unclosed hollow loop structure. The radiating portion 121 comprises a through hole 1211 and a gap 1210. Specifically, the radiating portion 121 has a strip-like shape, ends of which present circular arc transitions. The branch portion 122 is located at the middle part of a short-axis end of the radiating portion 121. Such a structure provides a larger receiving mounting space for the USB module 80 when the mobile terminal 100 is assembled. The antenna body 12 of this structure makes rational use of the space of the mobile terminal 100, which facilitates miniaturization of the mobile terminal 100. An end of the USB module 80 communicates with the through hole 1211, so that the USB module 80 can connect with an external circuitry directly and conveniently.

Additionally, a notch 1210 is provided on the radiating portion 121. Parameters of the antenna body 12 can be adjusted by adjusting the size of the notch 1210. In this implementation, the radiating portion 121 keeps a distance D from the grounding plate 13. The parameters of the antenna assembly 10 can be adjusted by adjusting the distance D in order to adjust the operating frequency band of the antenna assembly 10, so that the performance of the antenna assembly 10 can be optimized.

The branch portion 122 is located between the radiating portion 121 and the grounding plate 13. The branch portion 122 and the radiating portion 121 are formed integrally. The branch portion 122 comprises a first branch strip 1221 that connects with the radiating portion 121 and a second branch strip 1222 that extends vertically from the first branch strip 1221 toward the grounding plate 13. The first branch strip 1221 lies in the same plane as the second branch strip 1222. The first branch strip 1221 is located at the middle part of the short-axis end of the radiating portion 121. The second branch strip 1222 is disposed on a surface of a supporting plate 80 and keeps a distance from the grounding plate 13. The branch portion 122 is used as a feeding portion of the antenna body 12.

The metal frame 11 comprises a closed first loop portion 111 and a closed second loop portion 112 on two ends of the mobile terminal 100 respectively and connecting rods 113 that connect the first loop portion 111 and the second loop portion 112. The first loop portion 111 surrounds an outer periphery of the radiating portion 121, and an annular gap 101 is formed between the first loop portion 111 and the radiating portion 121. The radiating portion 121 is perpendicular to the first loop portion 111. The first loop portion 111 is coupled to the radiating portion 121 as a parasitic unit, so that the radiating area of the antenna assembly 10 is increased and the product performance is improved.

Additionally, since the first loop portion 111 of the metal frame 11 has a closed loop structure, the gap of the metal frame 11 is no longer the sensitive point of the antenna assembly 10, the structure is simplified and the product appearance becomes more aesthetic.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An antenna assembly for a mobile terminal, comprising:

a metal frame provided with a closed first loop portion, a second loop portion and connecting rods that connected the first loop portion with the second loop portion, a grounding plate located between the first loop portion and the second loop portion, and fixed on the connecting rods, so that the antenna assembly is grounded via the grounding plate, an antenna body provided with an unclosed loop structure used as a radiating portion of the antenna assembly and a T-shaped branch portion used as a feeding portion of the antenna assembly that extends vertically from an end of the radiating portion in a direction away from the radiating portion, wherein the radiation portion is received in the first loop portion, the first loop portion surrounds an outer periphery of the radiation portion, and an annular gap is formed between the first loop portion and the radiation portion, the T-shaped branch portion comprises a first branch strip that connects with the radiating portion and a second branch strip that extends vertically from the first branch strip toward the grounding plate, and the radiating portion and the branch portion are formed integrally, the branch portion is located between the radiating portion and the grounding plate, and the second branch strip keeps a distance from the grounding plate.

2. The antenna assembly of claim 1, wherein the first branch strip is located at the middle part of the short-axis end of the radiating portion.

3. A mobile terminal, comprising:

an antenna assembly, an enclosure, a lower cap cooperated with the enclosure to form a receiving space for receiving the antenna assembly, the antenna assembly comprising:

a metal frame fixed on the enclosure, and provided with a closed first loop portion, a second loop portion located and connecting rods that connected the first loop portion with the second loop portion, a grounding plate located between the first loop portion and the second loop portion, the grounding plate fixed on the connecting rods, so that the antenna assembly is grounded via the grounding plate, an antenna body provided with an unclosed loop structure used as a radiating portion and a T-shaped branch portion used as a feeding portion of the antenna body that extends vertically from an end of the radiating portion in a direction away from the radiating portion, wherein the radiation portion is received in the first loop portion, the first loop portion is surrounding an outer periphery of the radiation portion, and an annular gap is formed between the first loop portion and the radiation portion, the T-shaped branch portion comprises a first branch strip that connects with the radiating portion and a second branch strip that extends vertically from the first branch strip toward the grounding plate, and the radiating portion and the branch portion are formed integrally, the branch portion is located between the radiating portion and the grounding plate, and the second branch strip keeps a distance from the grounding plate.

4. The mobile terminal of claim 3, wherein the first branch strip is located at the middle part of the short-axis end of the radiating portion.

* * * * *